US012722196B2

(12) United States Patent
Jung

(10) Patent No.: US 12,722,196 B2
(45) Date of Patent: Sep. 1, 2026

(54) MANUAL PIPE BENDING APPARATUS HAVING IMPROVED BENDING WORK CONVENIENCE

(71) Applicant: Hyo Jin Jung, Goyang-si (KR)

(72) Inventor: Hyo Jin Jung, Goyang-si (KR)

( * ) Notice: Subject to any disclaimer, the term of this patent is extended or adjusted under 35 U.S.C. 154(b) by 445 days.

(21) Appl. No.: 18/289,742

(22) PCT Filed: Mar. 16, 2022

(86) PCT No.: PCT/KR2022/003662

§ 371 (c)(1),
(2) Date: Sep. 10, 2024

(87) PCT Pub. No.: WO2022/239950

PCT Pub. Date: Nov. 17, 2022

(65) Prior Publication Data

US 2025/0281959 A1 Sep. 11, 2025

(30) Foreign Application Priority Data

May 13, 2021 (KR) ..... 10-2021-0061964
May 26, 2021 (KR) ..... 10-2021-0067359

(51) Int. Cl.
*B21D 7/04* (2006.01)

(52) U.S. Cl.
CPC ..... *B21D 7/04* (2013.01)

(58) Field of Classification Search
CPC ... B21D 7/02; B21D 7/04; B21D 7/08; B21D 7/024

(Continued)

(56) References Cited

U.S. PATENT DOCUMENTS 4,428,216 A 1/1984 Fling
6,418,773 B1 * 7/2002 Tolman ..... B21D 7/024 72/388

(Continued)

FOREIGN PATENT DOCUMENTS

JP 2003266127 A 9/2003
JP 2006502864 A 1/2006

(Continued)

OTHER PUBLICATIONS

International Search Report—PCT/KR2022/003662 dated Jun. 22, 2022.

*Primary Examiner* — Teresa M Ekiert
(74) *Attorney, Agent, or Firm* — CANTOR COLBURN LLP

(57) ABSTRACT

Provided is a manual pipe bending apparatus having improved bending work convenience, the apparatus having an external gear formed on an outer peripheral surface of a bending shoe and having an operating ratchet engaging therewith, so that, when a worker rotates an operating lever to bend a pipe, rotation work, of the worker, for pushing or raising the operating lever is convenient and, when the operating lever is pushed once, the bending shoe can be rotated at a predetermined angle, thereby enabling the pipe to be bent uniformly at a predetermined degree, and thus easy bending work and a uniform bending angle can be expected. Between the operating parts, the operating ratchet which is rotated by a third rotating shaft and which has an end portion engaging with the external gear and an elastic means for applying elastic force to the operating ratchet are provided.

10 Claims, 6 Drawing Sheets

(58) Field of Classification Search
USPC ..... 72/149, 155, 157, 158, 166, 388
See application file for complete search history.

(56) References Cited

U.S. PATENT DOCUMENTS

| | | | | |
|---|---|---|---|---|
| 7,900,495 | B2 * | 3/2011 | Latoria | B21D 7/06 72/157 |
| 8,215,144 | B2 * | 7/2012 | Bulle | B21D 7/063 72/149 |
| 2017/0291206 | A1 | 10/2017 | Elder et al. | |

FOREIGN PATENT DOCUMENTS

| | | | |
|---|---|---|---|
| KR | 20100048363 | A | 5/2010 |
| KR | 101312469 | B1 | 9/2013 |
| KR | 101861444 | B1 | 5/2018 |

* cited by examiner

MANUAL PIPE BENDING APPARATUS HAVING IMPROVED BENDING WORK CONVENIENCE

TECHNICAL FIELD

The present disclosure relates to a pipe bending apparatus operated in a manual type. More particularly, the present disclosure relates to a manual pipe bending apparatus having improved bending work convenience, the manual pipe bending apparatus being configured such that a worker can easily push and raise an operating lever in bending a pipe by using an external gear formed on an outer peripheral surface of a bending shoe and an operating ratchet engaging with the external gear while the worker rotates the operating lever. Furthermore, due to this structure, the manual pipe bending apparatus of the present disclosure has excellent bending workability compared to bending workability of existing pipe bending apparatuses and is capable of being manufactured in a small and lightweight type, so that the manual pipe bending apparatus has improved mobility and is capable of being carried in a vehicle, thereby ultimately improving the bending work convenience.

Background Art

Generally, pipes are used for guiding electrical wires or used for transporting fluids (gas or liquid), and there are various types and uses of pipes. Pipes generally require bending in which the pipe is bent at a predetermined angle according to an installation location, and the pipe is used by bending the pipe at various angles such as 90 degrees, 45 degrees, and so on by using a bending apparatus.

Meanwhile, in the bending apparatus for bending the pipe, as a rotating shaft is gradually driven while the pipe that is the work object is seated and fixed on a bending shoe mounted on the rotating shaft, a rotation of the bending shoe is realized, and the bending of the pipe is performed according to a rotation angle of the bending shoe.

In addition, the configuration of the bending apparatus varies according to whether the bending shoe is rotated automatically or manually, and the present disclosure relates to a manual pipe bending apparatus in which a worker directly moves a lever up and down so as to operate a bending shoe.

Such a manual pipe bending apparatus is mainly used for bending of a small pipe compared to an automatic pipe bending apparatus, and the bending of the pipe in the manual pipe bending apparatus is performed on the basis of the worker's sense of rotating the lever, i.e., the bending of the pipe in the manual pipe bending apparatus is performed on the basis of the worker's experience of how much force the worker pushes the lever so as to rotate the bending shoe when the worker pushes the lever once.

As a manual pipe bending apparatus, Korean Patent No. 10-1861444 (May 18, 2018) filed and registered by the applicant of the present disclosure is provided.

In Korean Patent No. 10-1861444, a manual pipe bending apparatus having a simple structure for fastening components to each other is provided, but a rotation angle of a bending shoe when a worker rotates a lever once is not constant and the worker has difficulty in pushing the lever once smoothly, so that there is a limitation in that workability of the manual pipe bending apparatus in Korean Patent No. 10-1861444 is less than workability of the present disclosure described below.

Of course, in addition to Korean Patent No. 10-1861444, existing manual pipe bending apparatuses for bending a small pipe have a problem or a limitation mentioned above.

Furthermore, there are problems that the existing manual pipe bending apparatuses have sizes and weights difficult to be carried in a vehicle and mobilities of the existing manual pipe bending apparatuses are significantly reduced.

DISCLOSURE

Technical Problem

Accordingly, the present disclosure has been made keeping in mind the above problems and limitations occurring in a manual pipe bending apparatus.

First, an objective of the present disclosure is to provide a manual pipe bending apparatus configured to facilitate a worker to perform pushing work of a lever for rotating a bending shoe and configured to rotate the bending shoe by a predetermined angle when the pushing work is performed, thereby increasing workability.

Second, another objective of the present disclosure is to provide a manual pipe bending apparatus capable of realizing the objective described above, the manual pipe bending apparatus also having a simple internal structure and being capable of being manufactured in a small and lightweight type so that a worker can easily move the manual pipe bending apparatus, and the manual pipe bending apparatus being capable of being carried in a vehicle.

Technical Solution

In order to achieve the objectives described above, according to the present disclosure, there is provided a manual pipe bending apparatus.

The manual pipe bending apparatus includes: a support positioned on a floor; a support bracket coupled to a first side of the support; a rotating bracket coupled to a first side of the support bracket such that the rotating bracket is capable of being rotated, the rotating bracket having first and second rotating bracket plates which are integrally formed by being connected to each other with a space formed therebetween; a bending shoe coupled to the rotating bracket such that the bending shoe is capable of being rotated between the first and second rotating bracket plates by a first rotating shaft, the bending shoe having an outer peripheral surface provided with a guide groove to which a pipe that is inserted is guided; an operating part positioned above the bending shoe and coupled to the rotating bracket such that operating part is capable of being rotated by a second rotating shaft; and an operating lever coupled to a first side of the operating part and configured to control whether the operating part is rotated or not.

The guide groove may be formed on a part of the outer peripheral surface of the bending shoe, and an external gear may be formed on the outer peripheral surface of the bending shoe where the guide groove is not formed.

The working part may have first and second operating plates that are integrally formed by being connected to each other by a second connection pin with a space formed therebetween, and an operating ratchet which is configured to be rotated by a third rotating shaft and which has an end portion engaging with the external gear of the bending shoe and an elastic means configured to provide an elastic force to the operating ratchet may be provided between the first and second operating plates.

In addition, the external gear according to the present disclosure may be formed such that a center angle between one gear and a next gear of the external gear is 15 degrees.

In addition, the bending shoe according to the present disclosure may include a mounting jaw which is formed on a first side of the guide groove and on which an end portion of the inserted pipe is mounted, and an incision part in which a part thereof is cut-off may be formed on an upper side of the guide groove where the mounting jaw is positioned.

Advantageous Effects

According to the configuration described above, there are effects as follows.

Each time a worker pushes the operating lever once, the operating ratchet is engaging with the external gear, and the bending shoe is rotated by a predetermined angle. Furthermore, when the worker raises the operating lever, an engaged state of the external gear is released and the external gear is in ready for being in the engaged state again. Therefore, the worker can easily operate the operating lever and also a bending angle of the pipe is capable of being uniformly controlled, so that there is an effect that bending workability is increased compared to exiting pipe bending apparatuses.

In addition, since the manual pipe bending apparatus of the present disclosure is capable of being manufactured in a small and lightweight type compared to the existing pipe bending apparatuses, the manual pipe bending apparatus of the present disclosure is capable of being carried in a vehicle, so that there is an effect that the bending work of the pipe is capable of being easily performed by bringing the manual pipe bending apparatus of the present disclosure when the bending work of the pipe is required to be performed.

DESCRIPTION OF REFERENCE NUMERALS OF MAIN PARTS OF DRAWINGS

Figure 1:
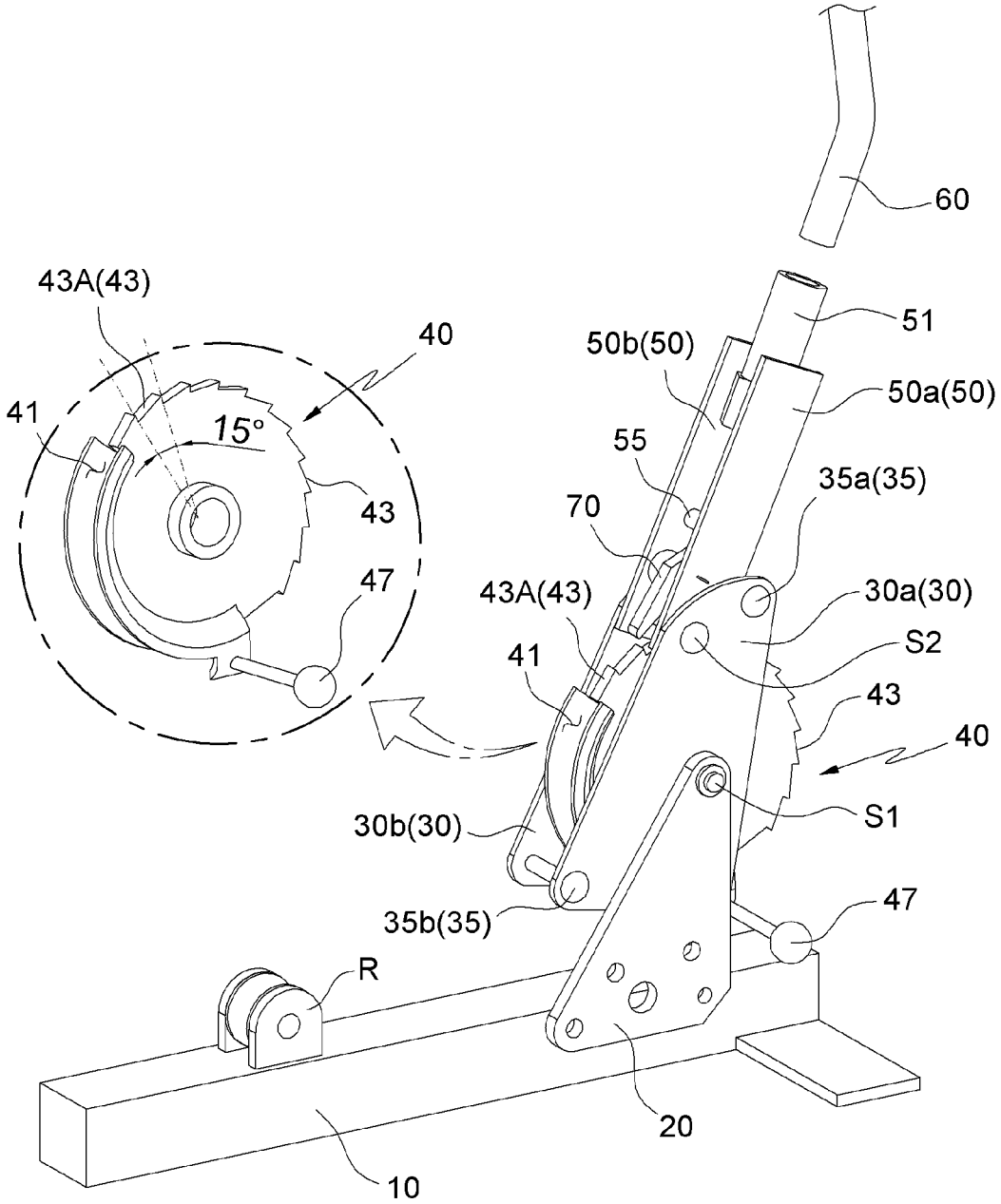
FIG. 1 is a view illustrating a state in which an operating part of a bending apparatus of the present disclosure is rotated to a rear side up to a first upper connection pin.

10: support 20: support bracket
30: rotating bracket 30*a*, 30*b*: first and second rotating bracket plates
35: first connection pin
40: bending shoe
41: guide groove 415: incision part
42: mounting jaw 425: additional incision part
43: external gear 47: handle
50: operating part 50*a*, 50*b*: first and second operating plates
51: mounting part 55: second connection pin
60: operating lever
70: operating ratchet 71: center part
72: engaging part 73: catching part
80: elastic means
S1: first rotating shaft S2: second rotating shaft
S3: third rotating shaft

MODE FOR INVENTION

Hereinafter, a manual pipe bending apparatus according to the present disclosure will be described in more detail.

The manual pipe bending apparatus according to the present disclosure is used by being placed on a floor, and includes a support 10 contacting a ground surface, a support bracket 20 coupled to the support 10, a rotating bracket 30 coupled to the support bracket 20, a bending shoe 40 and an operating part 50 that are coupled to the rotating bracket 30, and an operating lever 60 coupled to the operating part 50 and configured to rotate the operating part 50 up and down.

The support bracket 20 is configured to support the rotating bracket 30, and is coupled to a first side of the support 10 such that a side of the support 10 to which the support bracket 20 is not coupled is open, thereby providing a space where a pipe in which bending is finished is capable of being removed.

In addition, the support 10 is provided with a guide roller R. The guide roller R is configured to stably support the pipe together with a mounting jaw 42 of the bending shoe 40 which will be described later, and is configured to guide the pipe in a direction toward the bending shoe 40 during a process of bending, the pipe being inserted so as to be bent.

Figure 2:
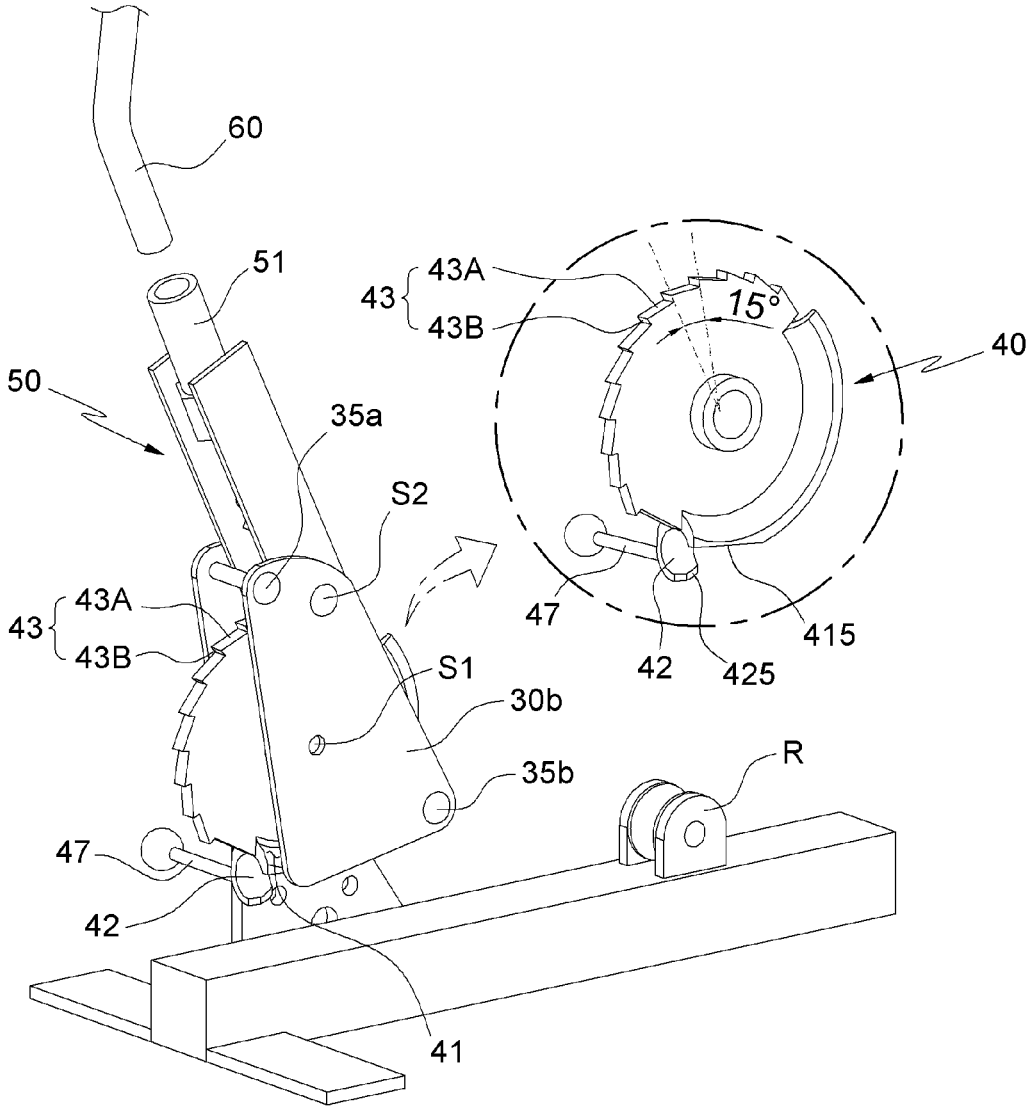
FIG. 2 is a view illustrating an opposite side of the bending apparatus of the present disclosure in the state illustrated in FIG. 1.
Figure 3:
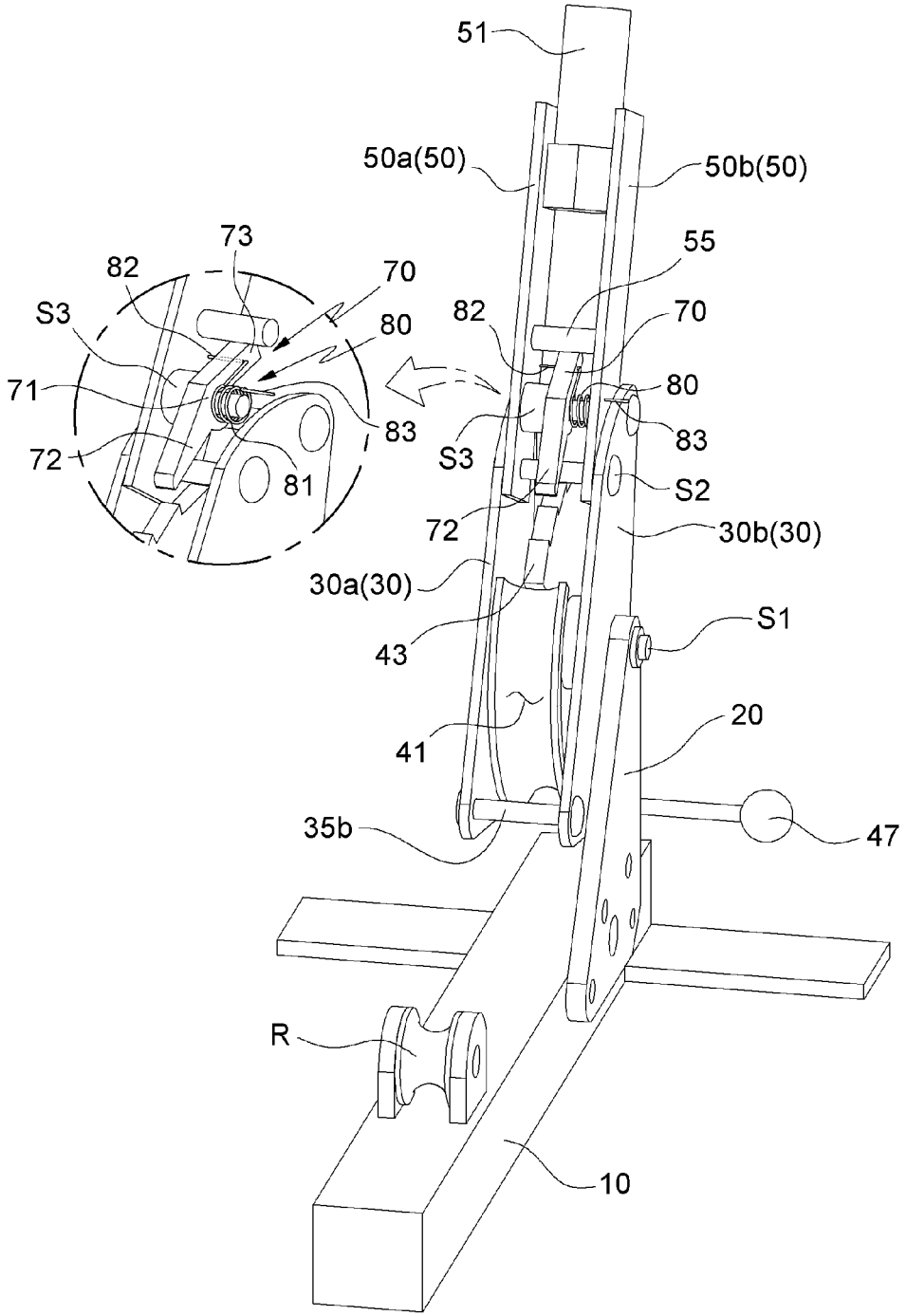
FIG. 3 is a view illustrating an internal structure of the bending apparatus of the present disclosure in the state illustrated in FIG. 1.

Next, referring to FIG. 1 to FIG. 3, in the rotating bracket 30, the rotating bracket 30 includes first and second rotating bracket plates 30*a* and 30*b* that are connected to each other by a first connection pin 35 with a space formed therebetween.

That is, the first and second rotating bracket plates 30*a* and 30*b* are in a state in which the first and second rotating bracket plates 30*a* and 30*b* are connected to each other by the first connection pin 35 while the space is formed therebetween. The first connection pin 35 includes a first lower connection pin 35*b* provided on a lower portion of the rotating bracket 30, and includes a first upper connection pin 35*a* provided on an upper portion of the rotating bracket 30. Furthermore, in order to maintain a stable coupling state, it is preferable that the first upper connection pin 35*a* and the first lower connection pin 35*b* are positioned diagonally to each other.

In addition, the first upper connection pin 35*a* is positioned at a rear side of the operating part 50, and is configured to control a rear rotation angle of the operating part 50. That is, when the operating part 50 is rotated to the rear side, the first upper connection pin 35*a* prevents the operating part 50 from being further rotated.

In addition, the bending shoe 40 is coupled such that the bending shoe 40 is capable of being rotated by a first rotating shaft S1 between the first and second rotating bracket plates 30*a* and 30*b*, and configurations of the bending shoe 40 and an operating ratchet 70 which will be described later have unique technical characteristics of the present disclosure compared to technical characteristics of existing manual pipe bending apparatuses.

The bending shoe 40 according to the present disclosure has a guide groove 41 to which the inserted pipe is guided as in the existing manual pipe bending apparatuses, but there is a difference that an external gear 43 in addition to the guide groove 41 is formed on an outer peripheral surface of the bending shoe 40.

That is, the guide groove 41 is formed on the outer peripheral surface of the bending shoe 40, but is formed on a part of the outer peripheral surface, and the external gear 43 is formed on the outer peripheral surface where the guide groove 41 is not formed. In addition, since the pipe is bent 15 degrees each time the bending shoe 40 is rotated by pushing the operating lever 60 once downward, the pipe is bent 90 degrees when the same work is performed six times. Therefore, it is preferable that the external gear 43 is designed such that a center angle between a gear and a next gear is 15 degrees.

Next, the operating part 50 according to the present disclosure is coupled such that the operating part 50 is capable of being rotated in the rotating bracket 30 by a second rotating shaft S2. When the operating lever 60 is coupled to the operating part 50 and the operating part 50 is rotated to a front side by a worker pushing the operating lever 60 downward, the operating part 50 serves to rotate the bending shoe 40 by the operating ratchet 70 which will be described later.

The operating part 50 includes second operating plates 50*a* and 50*b* that are integrally formed by being connected to each other with a second connection pin 55 while a space is formed between the first and second operating plates 50*a* and 50*b*, and the operating ratchet 70 which is configured to be rotated by a third rotating shaft S3 and which has an end portion engaging with the external gear 43 of the bending shoe 40 is coupled between the first and second operating plates 50*a* and 50*b*.

Referring to FIG. 3, the operating ratchet 70 is provided with an elastic force of rotation by an elastic means 80. Furthermore, the elastic means 80 includes a coil part 81 wound on the third rotating shaft S3, a first fixing part 82 connected to and formed on a first end of the coil part 81 and fastened to the operating ratchet 70, and a second fixing part 83 connected to and formed on a second end of the coil part 81 and fastened to the second operating plate 50*b*.

The operating ratchet 70 includes a center part 71 coupled to the third rotating shaft S3, an engaging part 72 which is connected to and formed on the center part 71 such that the engaging part 72 is formed toward a first side of the center part 71 and which has an end portion engaging with the external gear 43, and a catching part 73 which is connected to and formed on the center part 71 such that the catching part 73 is formed toward a second side of the center part 71 and which is configured to control a front rotation of the operating ratchet 70 by the second connection pin 55. That is, a force causing the operating ratchet 70 to rotate to the front side by the elastic means 80 is controlled since the catching part 73 is caught on the second connection pin 55.

Of course, the front rotation of the operating ratchet 70 may be controlled by further adding a configuration other than the second connection pin 55.

In addition, a mounting part 51 for mounting the operating lever 60 is provided at an upper portion between the first and second operating plates 50*a* and 50*b*. Furthermore, after the operating lever 60 and the operating part 50 are connected to each other by inserting the operating lever 60 into the mounting part 51, bending work is performed by pushing the operating lever 60 downward so that the operating lever 60 is rotated to the front side and the bending shoe 40 is also rotated to the front side in conjunction with the operating lever 60. Furthermore, when the bending work is completed, the operating lever 60 is separated and stored.

In order for the worker to push the operating lever 60 downward slightly more easily while the operating lever 60 is in a state in which the operating lever 60 is inserted into the mounting part 51, it is preferable for convenience of the bending work that the mounting part 51 is coupled to the first and second operating plates 50*a* and 50*b* while the mounting part 51 is in a state in which an upper portion of the mounting part 51 is inclined to the front side rather than the mounting part 51 is horizontally coupled between the first and second operating plates 50*a* and 50*b*.

Next, in the external gear 43 formed on the outer peripheral surface of the bending shoe 40, inclined surfaces of the gears are not formed at the same inclination, but are formed such that a first gear surface 43A seen from the front side has a gentle inclination and a second gear surface 43B has a steep inclination.

Therefore, in the bending work, pushing work of the operating lever 60 performed by the worker is capable of being easily performed. Furthermore, after bending the pipe once, the operating ratchet 70 is capable of being easily moved to a next neighboring gear for performing the next bending.

Next, a first side of the guide groove 41 of the bending shoe 40 is provided with the mounting jaw 42 for mounting an end portion of the pipe that is inserted into the bending apparatus along the guide groove 41, and it is preferable that an incision part 415 in which a part thereof is cut-off is formed on an upper side of the guide groove 41 where the mounting jaw 42 is positioned. This is a configuration that allows the pipe in which the bending work has been completed to be easily removed from the mounting jaw 42.

In addition, for the same an additional incision part 425 is formed in a part of the mounting jaw 42 in which a part of an end portion of the mounting jaw 42 is cut-off, so that a space where the pipe in which the bending work has been completed is capable of being easily escaped is provided, thereby facilitating removal of the pipe.

In addition, a handle 47 is provided on an outer peripheral surface of the mounting jaw 42, so that the worker can hold the handle 47 and can rotate the bending shoe 40 in a specific direction after starting and completing the bending work.

An operation process of the bending apparatus according to the present disclosure configured as described above is described as follows.

Figure 4A:
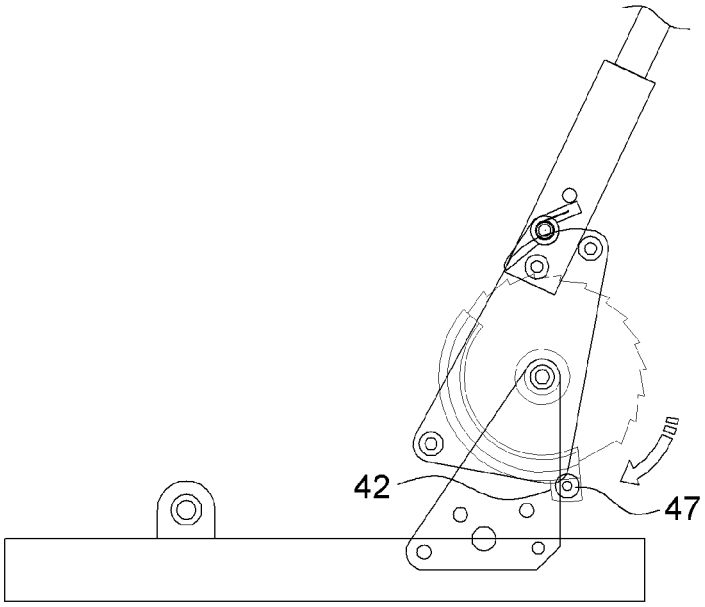
FIGS. 4A, 4B, 4C and FIGS. 5A, 5B, 5C show operating states of an operating ratchet and an external gear according to a work process.
Figure 4B:
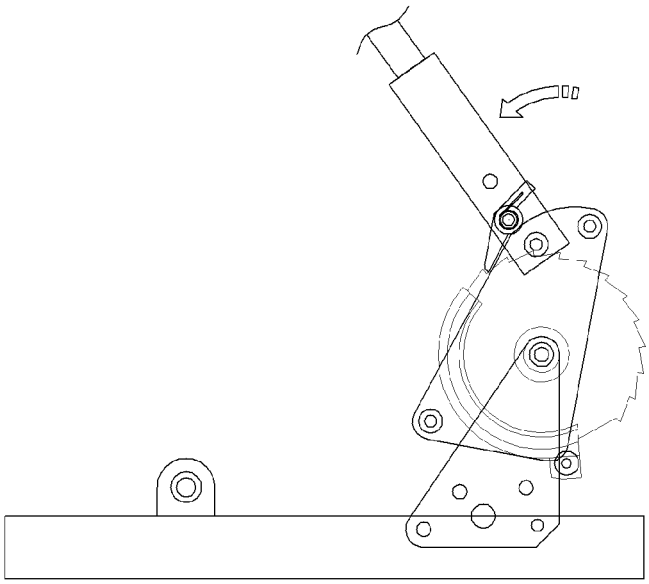
Figure 4C:
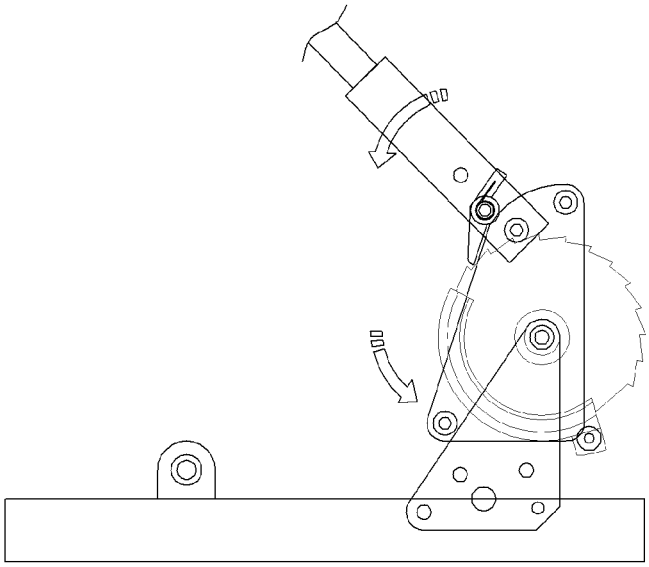

First of all, referring to FIGS. 4A to 4C, by holding and pushing the handle 47 downward, the bending shoe 40 is rotated to the rear side so that the mounting jaw 42 is positioned at a position where the end portion of the inserted pipe is capable of being mounted thereon.

In this case, in order to rotate the bending shoe 40 toward the rear side without interference from the operating ratchet 70, it is preferable that the operating part 50 is also rotated to the rear side. At this time, the rear rotation angle of the operating part 50 is controlled by the first upper connection pin 35*a* (see FIG. 4A).

As illustrated in FIG. 4A, after a preparation is performed by pushing the handle 47 downward such that the pipe is capable of being seated on the mounting jaw 42 of the bending shoe 40, the worker then inserts the pipe toward the bending shoe 40 along the guide roller R, then the end portion of the pipe is seated on the mounting jaw 42 by being guided along the guide groove 41, and then a preparation state before the bending work is completed.

Then, as illustrated in FIG. 4B, the worker inserts the operating lever 60 to the mounting part 51 of the operating part 50, and then pushes the operating lever 60 and the operating part 50 downward to a predetermined angle so that a state in which the engaging part 72 of the operating ratchet 70 is engaging with the external gear 43 is realized.

In this state, as illustrated in FIG. 4C, when the worker further pushes the operating lever 60 downward, the bending shoe 40 is rotated while the engaging part 72 is in a state in which the engaging part 72 is engaging with the external gear 43, and bending of the pipe is performed such that the pipe is bent by the rotation angle.

Figure 5A:
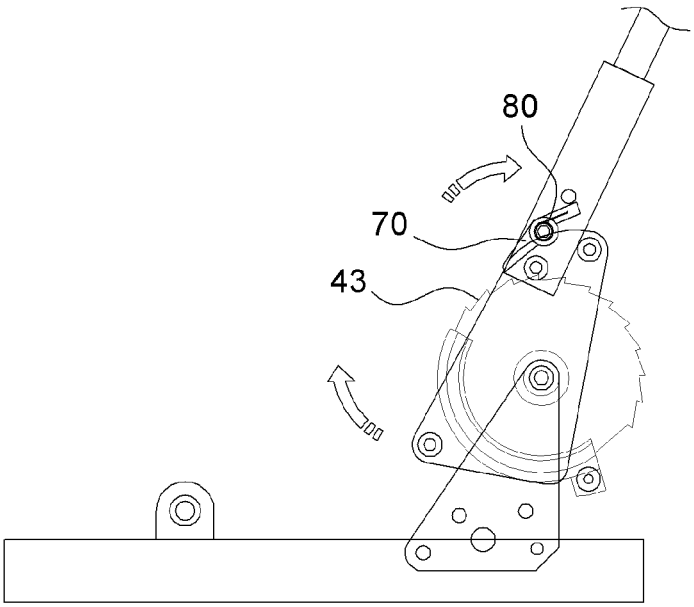
Figure 5B:
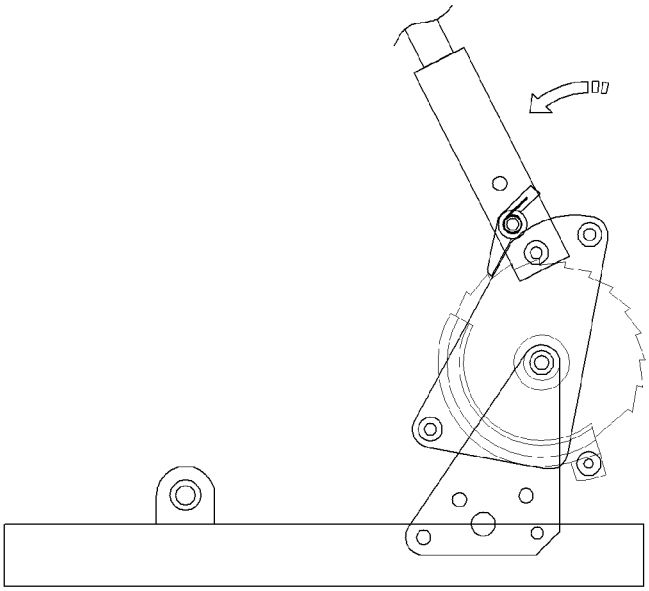

Then, as illustrated in FIG. 5A, the worker releases the engaged state of the operating ratchet 70 with respect to the external gear 43 while the worker raises the operating lever 60 and the operating part 50 upward by a predetermined angle. At this time, the engaging part 72 of the operating ratchet 70 is moved to the next external gear 43 by the elastic means 80. Furthermore, as illustrated in FIG. 5B, when the operating lever 60 and the operating part 50 is pushed down again, the engaged state of the operating ratchet 70 with respect to the next external gear 40 is realized.

Figure 5C:
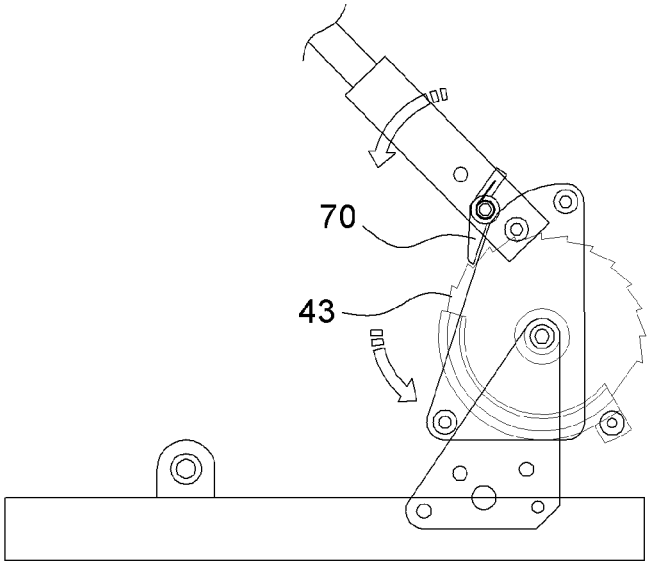

In addition, as illustrated in FIG. 5C, as the worker pushes the operating lever 60 and the operating part 50 again, the bending shoe 40 is rotated at the same angle as the described process above while the engaging part 72 of the operating ratchet 70 is the state in which the engaging part 72 is engaging with the next external gear 43, and the bending of the pipe is performed such that the pipe is bent by the rotation angle.

The bending of the pipe is performed by repeating the processes described above.

In this case, when the external gear 43 is formed on the outer peripheral surface of the bending shoe 40 such that the center angle between the gear and the next gear of the external gear 43 is 15 degrees, the pipe is bent 90 degrees while the processes described above are repeated six times.

Next, when the bending of the pipe is completed to the desired bending angle, the worker separates the operating lever 60 from the operating part 50, and the worker rotates the operating part 50 up to the first upper connection pin 35*a*, thereby completely releasing the engaged state of the operating ratchet 70 with respect to the external gear 43.

In addition, during the bending process, when the worker holds the handle 47 that is gradually raised upward due to the rotation of the bending shoe 40 and then the worker rotates the handle 47 downward (in this case, the state illustrated in FIG. 4A is realized), the bending shoe 40 is also rotated, and the pipe that is bent is removed from the bending apparatus during this process.

At this time, due to the incision part 415 formed on the guide groove 41 and the additional incision part 425 formed on the mounting jaw 42, the bent pipe is capable of being more easily removed while exiting the guide groove 41 and the mounting jaw 42.

In describing the present disclosure above, the manual pipe bending apparatus having the specific shape and the specific configuration has been mainly described with reference to the accompanying drawings, but the present disclosure may be variously modified, changed, and substituted by those skilled in the art. Such modification, change, and substitution should be construed as falling within the scope of the present disclosure.

The invention claimed is:

1. A manual pipe bending apparatus having improved bending work convenience, the manual pipe bending apparatus comprising:

a support positioned on a floor;

a support bracket coupled to a first side of the support;

a rotating bracket coupled to a first side of the support bracket such that the rotating bracket is capable of being rotated, the rotating bracket having first and second rotating bracket plates which are integrally formed by being connected to each other with a space formed therebetween;

a bending shoe coupled to the rotating bracket such that the bending shoe is capable of being rotated between the first and second rotating bracket plates by a first rotating shaft, the bending shoe having an outer peripheral surface provided with a guide groove to which a pipe that is inserted is guided;

an operating part positioned above the bending shoe and coupled to the rotating bracket such that operating part is capable of being rotated by a second rotating shaft; and an operating lever coupled to a first side of the operating part and configured to control whether the operating part is rotated or not, wherein an external gear is formed on the outer peripheral surface of the bending shoe, and the operating part has first and second operating plates that are integrally formed by being connected to each other by a second connection pin with a space formed therebetween, and an operating ratchet which is configured to be rotated by a third rotating shaft and which has an end portion engaging with the external gear of the bending shoe and an elastic means configured to provide an elastic force to the operating ratchet are provided between the first and second operating plates.

2. The manual pipe bending apparatus of claim 1, wherein the external gear is formed such that a first gear surface has a gentle inclination and a second gear surface has a steep inclination.

3. The manual pipe bending apparatus of claim 1, wherein the external gear is formed such that a center angle between one gear and a next gear of the external gear is 15 degrees.

4. The manual pipe bending apparatus of claim 1, wherein the operating ratchet is provided with a center part to which the third rotating shaft is coupled, an engaging part which is connected to and formed on the center part such that the engaging part is formed toward a first side of the center part and which is engaging with the external gear, and a catching part which is connected to and formed on the center part such that the catching part is formed toward a second side of the center part and which is configured to control a front rotation angle of the operating ratchet by the second connection pin.

5. The manual pipe bending apparatus of claim 1, wherein a first connection pin connecting the first and second rotating bracket plates to each other has a first lower connection pin provided on a lower portion of the rotating bracket and a first upper connection pin provided on an upper portion of the rotating bracket, and the first upper connection pin is positioned on a rear side of the operating part and is configured to control a rear rotation angle of the operating part.

6. The manual pipe bending apparatus of claim 1, wherein the bending shoe comprises a mounting jaw which is formed on a first side of the guide groove and on which an end portion of the inserted pipe is mounted, and an incision part in which a part thereof is cut-off is formed on an upper side of the guide groove where the mounting jaw is positioned.

7. The manual pipe bending apparatus of claim 6, wherein an additional incision part in which a part thereof is cut-off is formed on an end portion of the mounting jaw.

8. The manual pipe bending apparatus of claim 6, wherein the mounting jaw is provided with a handle for rotating the bending shoe.

9. The manual pipe bending apparatus of claim 1, wherein the operating lever is capable of being detached from or attached to the operating part.

10. The manual pipe bending apparatus of claim 1, wherein the support is provided with a guide roller configured to stably support the pipe that is inserted so as to be bent.

* * * * *